US010315223B2

(12) United States Patent
Zhang et al.

(10) Patent No.: US 10,315,223 B2
(45) Date of Patent: Jun. 11, 2019

(54) ULTRA BROADBAND SOUND AND ULTRASONIC TRANSDUCER

(71) Applicant: Microfine Materials Technologies Pte Ltd., Singapore (SG)

(72) Inventors: Shuangjie Zhang, Singapore (SG); Dian-Hua Lin, Singapore (SG)

(73) Assignee: MICROFINE MATERIALS TECHNOLOGIES PTE LTD., Singapore (SG)

( * ) Notice: Subject to any disclaimer, the term of this patent is extended or adjusted under 35 U.S.C. 154(b) by 240 days.

(21) Appl. No.: 15/115,163

(22) PCT Filed: Feb. 18, 2014

(86) PCT No.: PCT/SG2014/000060

§ 371 (c)(1),
(2) Date: Jul. 28, 2016

(87) PCT Pub. No.: WO2015/126321

PCT Pub. Date: Aug. 27, 2015

(65) Prior Publication Data

US 2016/0346809 A1 Dec. 1, 2016

(51) Int. Cl.
*B06B 1/06* (2006.01)

(52) U.S. Cl.
CPC ..... *B06B 1/0648* (2013.01); *B06B 1/0611* (2013.01)

(58) Field of Classification Search
CPC ..... B06B 1/06; B06B 1/0603; B06B 1/0611; B06B 1/0648
USPC ..... 310/322, 334, 335
See application file for complete search history.

(56) References Cited

U.S. PATENT DOCUMENTS

| | | | | |
|---|---|---|---|---|
| 5,291,090 | A | 3/1994 | Dias | |
| 2002/0157472 | A1 | 10/2002 | Stephens | |
| 2004/0070315 | A1* | 4/2004 | Takeuchi | H01L 27/20 310/334 |
| 2006/0241468 | A1 | 10/2006 | Lu | |
| 2012/0236689 | A1 | 9/2012 | Brown | |

(Continued)

OTHER PUBLICATIONS

Ensminger, D. "Ultrasonics: Data, Equations and Their Practical Uses", CRC Press, US, pp. 185-187 and 223.

(Continued)

*Primary Examiner* — Derek J Rosenau
(74) *Attorney, Agent, or Firm* — Cantor Colburn LLP

(57) ABSTRACT

The present invention provides a transverse width mode for sound and ultrasound generation and reception. The transverse width mode can be combined with conventional longitudinal or transverse mode to make sonic and ultrasonic transducers and/or arrays of multiple resonant modes, a broadband coupled mode or their combinations. Due to its half-wavelength resonance nature, when the transverse width mode is designed to operate with suitable head mass and/or matching layers, ultra broadband transducers of moderate to high sound pressure level can be realized. With active materials having low transverse sound velocities, the transverse dimensions of each transducer element can be kept about or smaller than half the wavelengths of sounds in water and human tissues, making the transverse width mode highly suited for various array designs and operations.

14 Claims, 12 Drawing Sheets

(56) References Cited

U.S. PATENT DOCUMENTS

2016/0136687 A1* 5/2016 Lewis, Jr. ..... B06B 1/0618
310/322

OTHER PUBLICATIONS

International Preliminary Report on Patentability for corresponding application PCT/SG2014/000060 filed Feb. 18, 2014; dated Oct. 16, 2015.
International Search Report for corresponding application PCT/SG2014/000060 filed Feb. 18, 2014; dated Jun. 10, 2014.
L. C. Lim, "Pb(Zn1/3Nb2/3)O3—PbTiO3 single crystal and device development", Journal of Advanced Dielectrics, vol. 4, No. 1 (2014) 1350026 (5 pages).
Written Opinion of ISA for corresponding application PCT/SG2014/000060 filed Feb. 18, 2014; dated Jun. 10, 2014.
Written Opinion of the IPEA for corresponding application PCT/SG2014/000060 filed Feb. 18, 2014; dated Jul. 15, 2015.
S. Zhang, "Transverse resonance orthogonal beam (TROB) mode for broadband underwater sound generation", Sensors and Actuators A 266 (Sep. 22, 2017) 285-293.

* cited by examiner

ULTRA BROADBAND SOUND AND ULTRASONIC TRANSDUCER

TECHNICAL FIELD

This invention relates to piezoelectric transducers, specifically, the present invention relates to arrays of piezoelectric transducers for sound and ultrasound generation, transmission and reception.

BACKGROUND OF THE INVENTION

Modern transducer arrays for sound and ultrasound generation consist of an orderly arrangement of identical or approximately identical transmitting elements which are designed to operate in either the longitudinal mode or a transverse mode. Where possible, the lateral or transverse dimensions of an individual transducer are selected to be approximately equal to or less than half the wavelength of sound of designed frequency in the intended acoustic medium ($\lambda_m/2$) to yield a strong and focused main acoustic beam while avoiding grating lobes. In addition, the strength of side lobes is kept low via beamforming and/or beam shading technique.

FIG. 1 shows an example of such a transmitting array 100 used in a side-scan or synthetic aperture sonar for underwater imaging purposes in which discrete rectangular elements 102 are spaced about $\lambda_m/2$ apart in longitudinal and crosswise directions, where $\lambda_m$ is the wavelength of sound or ultrasound of designed central frequency in water. Using discrete transducer elements 102 in an array enables the main acoustic beam to be steered electronically via the elemental phasing technique. The control of the elemental separation in the array is important in such an application.

FIG. 2 illustrates an example of a 1D phased array medical transducer 200 used for both ultrasound transmission and reception in medical imaging reported in 'Forty-channel phased array ultrasonic probe using $0.91Pb(Zn_{1/3}Nb_{2/3})O_3$-$0.09PbTiO_3$ single crystal' by Saitoh et al. The array 200 demonstrates discrete sliver elements spaced about $\lambda_m/2$ apart in the longitudinal direction, where $\lambda_m$ is the wavelength of ultrasound of designed central frequency in human tissues. In such a device, top and bottom electroded faces 210 and 212 respectively are bonded onto a piezoelectric active material 204, which in turn is bonded onto a backing material 214 while an acoustic matching layer 206 is bonded onto the top electrode layer 210. The active material 204 is then diced into discrete silver elements together with the top electrode layer 210 and the matching layer 206. Finally, an acoustic lens 208 is placed over the acoustic matching layer 206 as shown in the figure.

Similar transducer arrays are also used for sound and ultrasound reception. While it is common for such receiving arrays to operate in off-resonance mode, they exhibit enhanced receiving sensitivity for sounds of frequencies comparable to the resonance frequencies of the constituting elements in the receiving mode.

Modern ultrasonic transmitting elements are driven by lead zirconate titanate ($PbZr_{0.52}Ti_{0.48}O_3$ or PZT) polycrystalline ceramics. For direct-drive, piston-less transmitting elements, rectangular, rod or tube shaped ceramics are commonly used. These ceramics are poled across two opposite faces which act as electrodes to attend the desired piezoelectric properties. Conventionally, this poling direction is designated as the 3– direction.

In a longitudinal (33) mode operation, an active material is activated along the poling (3–) direction which is also the acoustic beam direction. An example of a transducer element 300 operating in the longitudinal (33) mode is provided in FIG. 3. In this figure, an active element 302 is provided with a backing material 304. The backing material 304 is a soft and high-damping backing material, which has the effect of decreasing ringing of the active element 302 for improved axial resolution when short pulse length signal is used. It also helps to widen the bandwidth of the transducer 300 at the expense of acoustic power. The shaded top face 306 and the bottom face 308 opposite to the top face 306 of the active element 302 act as electrodes. In such a design, the active material 302 in the activated direction is typically of half-wavelength ($\lambda_c/2$) in dimension, where $\lambda_c = v_{33}^D/f$, $v_{33}^D$ is the sound velocity of the ceramic or single crystal active material along the activated longitudinal (3–) direction;

f is the desired sound frequency;

$^D$ indicates that the active material 302 is under a state of constant electrical displacement.

In the conventional transverse (31) mode operation, the active material is excited in resonance in one of the two lateral or transverse directions, which is also the acoustic beam direction. An example of a transducer element 400 operating in the transverse mode is provided in FIG. 4. In this figure, the shaded side face 404 and the face opposite (not shown in figure) to the side face 404 of the active element 402 act as electrodes. A heavy tail mass is used as the backing material 406 which helps to project the acoustic power towards the front direction. In such a design, the active element 402 in the activated direction is typically of quarter-wavelength ($\lambda_c/4$) in dimension. The relevant sound velocity in the active element 402 is along the activated transverse (1–) direction, designated as $v_{11}^E$ (or $v_{22}^E$) where the subscripts "$_1$" (or "$_2$") indicate the activated direction being 1– (or 2–) of the two possible transverse directions and the superscript "E" indicates that the active element 402 is under a state of constant electrical field in this case.

In the design of transducers operating in either the longitudinal mode or the transverse mode described above, the four side faces of the active element 302 or 402 may be shielded from the propagation medium with a soft and high-damping material to ensure that the active element is not unduly constrained laterally and free to vibrate or resonate in the intended mode and that sound wave propagation in the intended acoustic direction is realized. The stress/pressure release materials, housing as well as the lead wires connected to the electroded faces, are not shown in FIGS. 3 and 4 for clarity sake.

Polycrystalline PZT ceramics and their doped derivatives, the most popular active material for ultrasonic transducers and arrays as of to-date, have much superior longitudinal piezoelectric properties ($d_{33}$ and $k_{33}$ values) than transverse properties ($d_{31}$ and $k_{31}$ values) where d and k are the piezoelectric strain coefficient and the electromechanical coupling factor respectively; the first subscript $_3$ indicates that the applied electric field is in the "3"– or poling direction and the second subscript indicates the activated direction –"3" for longitudinal actuation and "1" or "2" for transverse actuation. For instance, for typical PZT ceramics, while $d_{33}$=300-600 pC/N and $k_{33}$=0.6-0.7 for the longitudinal mode, $d_{31}$=150-300 pC/N and $k_{31}$=0.34-0.40 for the transverse mode. Compared with the longitudinal properties, the transverse properties are not as favorable for efficient sound and ultrasound generation. Also, the sound velocities in both the longitudinal and transverse directions (of >2000 m/s typically) are much higher than velocities of sounds in water and human tissues. The high sound velocities and inferior transverse properties of PZT-based ceramics make longitudinal mode transducers and arrays much more popular than the transverse mode ones for sound and ultrasound generation for underwater and/or medical applications.

Another reason for the low popularity of transverse mode transducer arrays notably in the medical field is the difficulty involved in fabricating such an array by the established automatic dicing operation. The deposition of electrodes on both transverse faces and their wiring are problematic for such an array configuration.

OBJECTS OF THE INVENTION

It is an object of the present invention to overcome, or at least substantially ameliorate, the disadvantages and shortcomings of the prior art.

It is an object of the present invention to excite an active element, which is preferably rectangular in shape, to resonate in one of the two orthogonal transverse directions such that it generates acoustic sound in either the longitudinal or the other transverse direction. This particular mode of operation is hereafter referred to as the "transverse width mode".

It is also an object of the present invention to provide a sound or ultrasound transmitting element and its array which operates via the transverse width mode that uses relaxor based ferroelectric/piezoelectric single crystals.

It is further an object of the present invention to use the same element and array for sound and ultrasound reception at enhanced receiving sensitivity when the frequency of incoming sound coincides with the transverse width mode resonance of the transducer element in the receiving mode.

It is an object of the present invention to provide a transducer designed to operate in either a single transverse width mode, or dual or triple frequency modes of which at least one of the resonant modes is the transverse width mode, or a broadband coupled mode of which at least one of the fundamental modes is the transverse width mode, or other derivative forms such as with a suitable head mass, matching and/or lens layer.

It is further an object of the present invention to utilize the transverse width mode in sound and ultrasound generation and reception in the underwater, medical and industrial fields.

SUMMARY OF THE INVENTION

The objects of the invention are achieved by providing a new operating mode, called the transverse width mode, of piezoelectric transducers for sound and ultrasound generation and reception.

According to an embodiment of the present invention, a transducer includes an active element electroded on two opposite faces and poled across the electroded faces such that when the active element is set in resonance in a direction transverse to the poling direction, an acoustic beam is generated at a right angle to the resonating transverse or width direction of the active element such that the acoustic beam direction is one of the poling direction or the other transverse direction.

According to an embodiment of the present invention, the active element includes either a single piece of active material or a plurality of active materials of identical or comparable dimensions and cut, of either rectangular shape or appropriately tapered profile in at least one dimension, which are electrically coupled in one of a parallel, series, part-parallel or part-series configuration.

According to another embodiment of the present invention, the active material is excited in half-wavelength resonant mode in the activated transverse direction.

According to another embodiment of the present invention, the transducer includes a backing element bonded onto the face opposite to the acoustic wave emitting face of the active element. The backing element may be one of a heavy tail mass or a soft and high-damping backing material to suit a desired application.

According to an embodiment of the present invention, the transducer includes a direct-drive, piston-less design or with a head mass of either a rigid or flexural type to suit a desired application.

According to another embodiment of the present invention, the transducer includes one or more than one matching layer attached to the acoustic wave emitting face of the active element.

According to another embodiment of the present invention, the transducer includes one or more than one lens layer provided on top of the matching layer.

According to another embodiment of the present invention, the active element possesses transverse piezoelectric properties of $d_{31}$ (or $d_{32}$)≥400 pCN and $k_{31}$ (or $k_{32}$)≥0.60 in at least one of the two transverse directions, where $d_{31}$, $d_{32}$ are the associated transverse piezoelectric strain coefficients, and $k_{31}$, $k_{32}$ are the associated electromechanical coupling factors.

According to yet another embodiment of the present invention, the active element includes suitable cuts of relaxor based ferroelectric or piezoelectric single crystals of binary, ternary, and higher-order solid solutions of one or more of $Pb(Zn_{1/3}Nb_{2/3})O_3$, $Pb(Mg_{1/3}Nb_{2/3})O_3$, $Pb(In_{1/2}Nb_{1/2})O_3$, $Pb(Sc_{1/2}Nb_{1/2})O_3$, $Pb(Fe_{1/2}Nb_{1/2})O_3$, $Pb(Yb_{1/2}Nb_{1/2})O_3$, $Pb(Lu_{1/2}Nb_{1/2})O_3$, $Pb(Mn_{1/2}Nb_{1/2})O_3$, $PbZrO_3$ and $PbTiO_3$, including their modified and/or doped derivatives.

According to yet another embodiment of the present invention, the active element includes a $[011]_3$-poled single crystal of $[0\text{-}11]_1 \times [100]_2 \times [011]_3$ cut, where $[011]_3$ is the longitudinal, direction, and $[0\text{-}11]_1$ and $[100]_2$ are the two lateral or transverse directions.

According to yet another embodiment of the present invention, the active element includes a $[001]_3$-poled single crystal of $[110]_1 \times [1\text{-}10]_2 \times [001]_3$ cut, where $[001]_3$ is the longitudinal direction, and $[110]_1$ and $[1\text{-}10]_2$ are the two crystallographically equivalent lateral or transverse directions.

According to a further embodiment of the present invention, the active element includes suitably cut and poled textured piezoelectric ceramics which possess transverse piezoelectric properties of $d_{31}$ (or $d_{32}$)≥400 pCN and $k_{31}$ (or $k_{32}$)≥0.60 in at least one of the two transverse directions, where $d_{31}$, $d_{32}$ are the associated transverse piezoelectric strain coefficients, and $k_{31}$, $k_{32}$ are the associated electromechanical coupling factors.

According to a further embodiment of the present invention, the active element includes compositions and cuts of piezoelectric single crystals and of textured polycrystalline ceramics which possess transverse piezoelectric properties of $d_{31}$ (or $d_{32}$)≥400 pCN and $k_{31}$ (or $k_{32}$)≥0.60 in at least one of the two transverse directions, where $d_{31}$, $d_{32}$ are the associated transverse piezoelectric strain coefficients, and $k_{31}$, $k_{32}$ are the associated electromechanical coupling factors.

According to another embodiment of the present invention, the active element includes modified and/or new compositions of non-textured polycrystalline piezoelectric ceramics which possess transverse piezoelectric properties of $d_{31}$ (or $d_{32}$)≥400 pCN and $k_{31}$ (or $k_{32}$)≥0.60 in at least one of the two transverse directions, where $d_{31}$, $d_{32}$ are the associated transverse piezoelectric strain coefficients, and $k_{31}$, $k_{32}$ are the associated electromechanical coupling factors.

According to another embodiment of the present invention, the active element includes an active material of comparatively low sound velocities in at least one lateral or transverse direction, being comparable or lower in magnitude than the sound velocities in the intended acoustic medium.

According to an embodiment of the present invention, the dimension of the active element in at least one lateral or transverse width direction is comparable, the same or smaller than half the wavelength ($\lambda_m/2$) of sound of the designed frequency in the intended acoustic medium, where $\lambda_m$ is the wavelength of sound and ultrasound of designed central frequency in the intended acoustic medium.

According to an embodiment of the present invention, the sound velocities of the active element in both transverse width directions are larger than the sound velocity in the intended acoustic medium, in which the lateral dimensions of the active element of individual transducer elements are larger than half the wavelength ($\lambda_m/2$) of sound of the designed frequency in the intended acoustic medium, where $\lambda_m$ is the wavelength of ultrasound of designed central frequency in the intended acoustic medium.

According to an embodiment of the present invention, the transducer is used for sound and ultrasound transmission and reception.

According to another embodiment of the present invention, a device for sound and ultrasound generation and/or reception is provided which includes an array of transducers. Each transducer includes an active element electroded on two opposite faces and poled across the electroded faces, wherein when the active element is set in resonance in a direction transverse to the poling direction, an acoustic beam is generated at a right angle to a resonating transverse or width direction of the active element, wherein the acoustic wave emitting direction comprises one of the poling direction or the other transverse direction.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the disclosure is not limited to specific methods and instrumentalities disclosed herein. Moreover, those in the art will understand that the drawings are not to scale.

DETAILED DESCRIPTION OF ILLUSTRATIVE EMBODIMENTS

The embodiments discussed in the following description are non-limiting examples and are cited merely to illustrate at least one embodiment and are not intended to limit the scope thereof.

The present invention provides a new operating mode for sound and/or ultrasound generation, transmission and reception. A transducer employing the new operating mode includes an active element which upon activation generates an acoustic beam such that the direction of the acoustic beam is at right angle to the resonating lateral or width direction of the active material. This is in contrast to the conventional transverse mode in which the resonating direction of the active material and the acoustic beam direction are the same.

Figure 1:
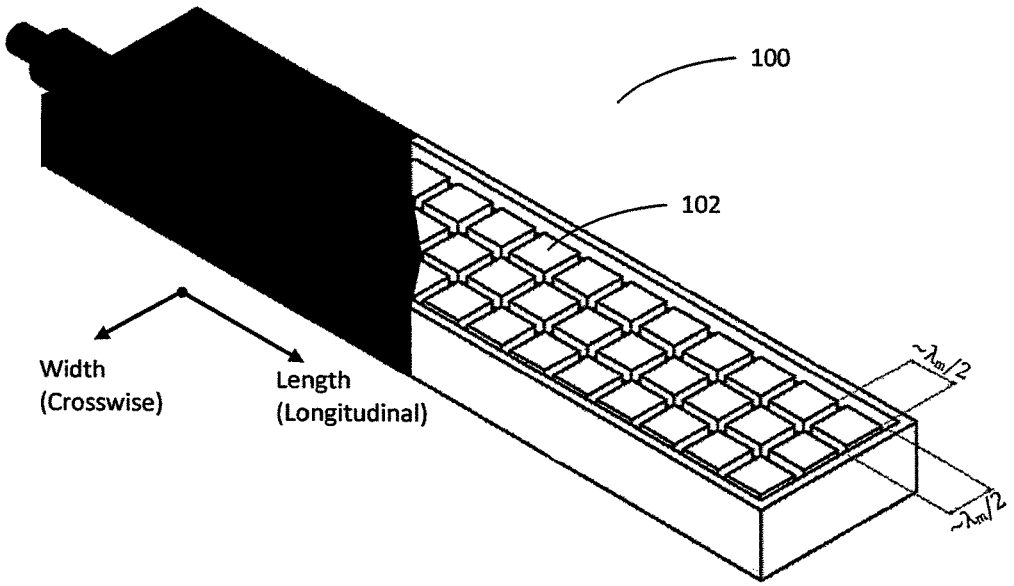
Figure 1 (Prior Art)
FIG. 1 illustrates a conventional planar transmitting array in accordance with a known art.
Figure 2:
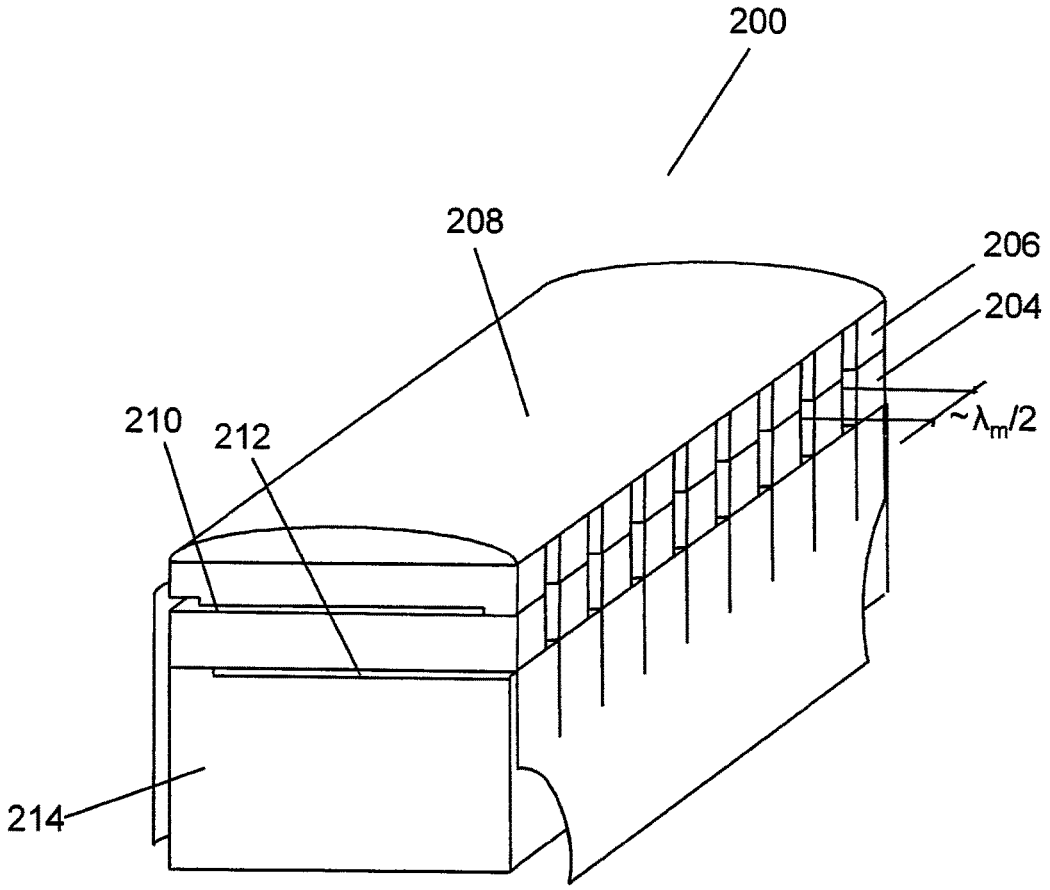
Figure 2 (Prior Art)
FIG. 2 illustrates a 1D phased array medical transducer used for both ultrasound transmission and reception in medical imaging in accordance with another known art.
Figure 3:
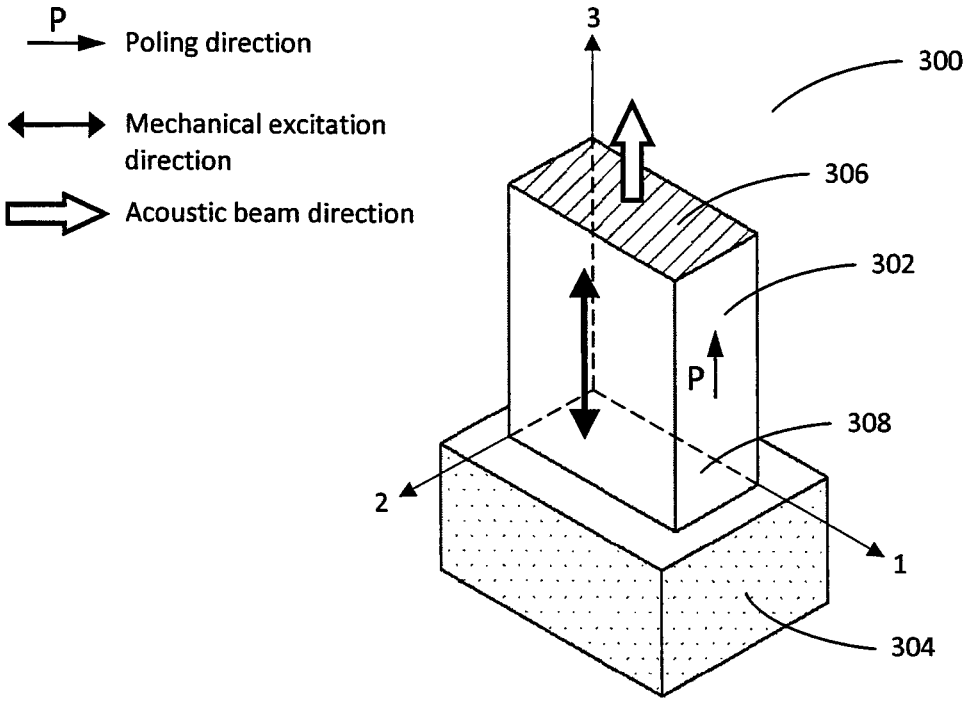
Figure 3 (Prior Art)
FIG. 3 illustrates the operating principle of a rectangular active element with a soft and high-damping backing layer resonating in the $\lambda_c/2$ longitudinal (33) mode known in the art.
Figure 4:
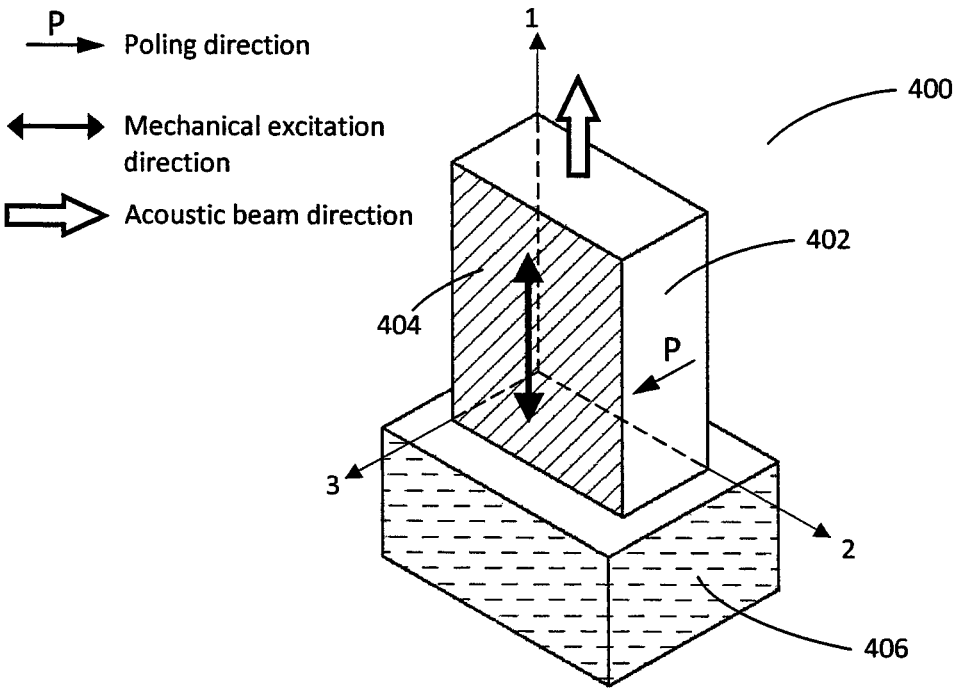
Figure 4 (Prior Art)
FIG. 4 is a schematic depicting the operating principle of a rectangular active element with a heavy tail mass resonating in the $\lambda_c/4$ transverse (31) mode known in the art.
Figure 5:
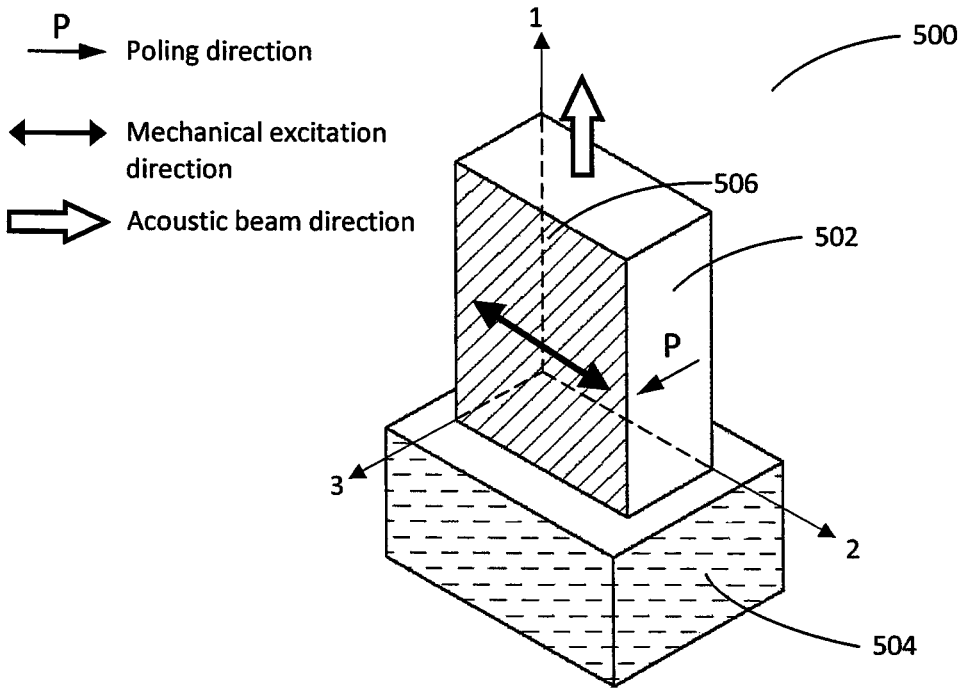
FIG. 5 illustrates the operating principle of an active element resonating in a transverse width mode in accordance with an embodiment of the present invention.

FIG. 5 illustrates a transducer 500 operating in the new operating mode of the present invention. The transducer 500 includes an active element 502, a backing element 504, two electroded faces—506 and its opposite face, and lead wires coupled to the electoded faces. The active element 502 is made of an active material that demonstrates piezoelectric properties and is preferably rectangular in shape. The backing element 504 may be a heavy tail mass made of, for example, stainless steel or tungsten. The heavy backing element 504 helps to project the acoustic power towards the front direction. The shaded side face 506 and its opposite face (not shown in figure) are electroded faces which in turn are coupled to the lead wires. The surrounding stress/pressure release materials, the lead wires connected to each of the electroded faces and the housing are not shown for clarity.

When a voltage is applied to the lead wires, the active material may be excited, that is, the active material may be set in resonance in a transverse width direction. The excitation of the active material is depicted by mechanical excitation direction arrow in the figure. The excitation of the active material takes place in half-wavelength ($\lambda_c/2$) resonant mode. As a result of resonance, an acoustic beam may be generated. In the present invention, unlike conventional transverse mode operation, the direction of the generated acoustic beam is orthogonal to the excited transverse width direction. The poling direction, mechanical excitation direction and the acoustic beam direction are shown in the figure. This new mode of operation is hereafter referred to as the "transverse width mode" to distinguish it from the conventional transverse mode of operation, the latter hereafter referred to as the "transverse length mode".

Figure 6:
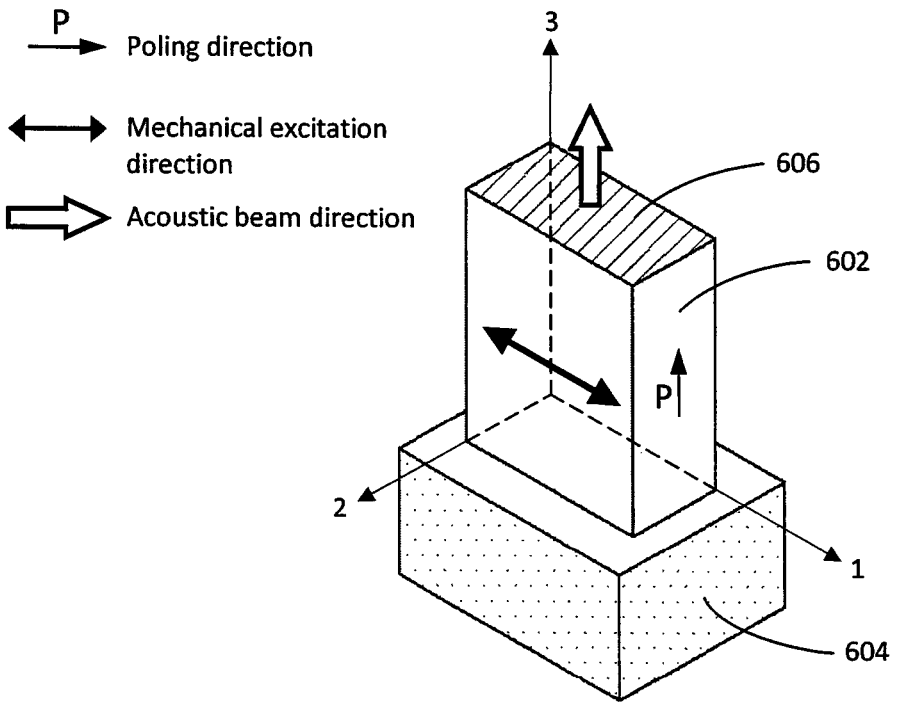
FIG. 6 shows the operating principle of an active element resonating in the transverse width mode in accordance with another embodiment of the present invention.

The transverse width mode of the present invention can also be activated by exciting the active material of the active element along a suitable lateral or transverse width direction with the resulting acoustic beam being generated in the longitudinal direction as shown exemplarily in FIG. 6. In this figure, the top face 606 and its opposite face of the active element 602 are the electroded faces. The backing element 604 may be a soft and high-damping backing material. The surrounding stress/pressure release material, the lead wires connecting to each of the electroded faces and the housing are not shown for clarity. In this example too, the active material of the active element 602 may be excited in half-wavelength ($\lambda_c/2$) resonant mode.

In the two examples cited above, while a heavy tail mass is used in FIG. 5, a soft and high-damping backing material is used in FIG. 6. The choice of either tail mass or soft backing material depends on actual application requirements.

For effective activation of the transverse width mode in the active materials of the active element 502 or 602, the active material may have reasonably high transverse piezoelectric properties, notably transverse piezoelectric strain coefficient ($d_{31}$ or $d_{32}$) and electromechanical coupling factor ($k_{31}$ or $k_{32}$) in the excited lateral or width direction. For example, $d_{31}$ may be greater than or equal to 400 pCN while $k_{31}$ may be greater than or equal to 0.60. Preferably, the active material may provide a sound velocity along at least one of the two transverse directions that is comparable or smaller than the sound velocity in the intended acoustic medium. This may enable the active element 502 or 602 of dimension approximately $\lambda_m/2$ or less than $\lambda_m/2$ in the activated width direction to be realized to meet the $\lambda_m/2$ elemental separation in an array design, where $\lambda_m$ is the wavelength of sound of the designed central frequency in the intended acoustic medium. For example, water may be an intended acoustic medium for underwater application while human tissues for medical application.

Active materials exhibiting the above properties include without limitation, new-generation relaxor based ferroelectric/piezoelectric single crystals, for example, solid solution single crystals of lead zinc niobate-lead titanate ($Pb[Zn_{1/3}Nb_{2/3}]O_3$—$PbTiO_3$ or PZN-PT), of lead magnesium niobate-lead titanate ($Pb[Mg_{1/3}Nb_{2/3}]O_3$—$PbTiO_3$ or PMN-PT), of lead magnesium niobate-lead zirconate titanate (PMN-PZT), and their compositionally modified ternary and quaternary and doped derivatives. Suitable cuts of these crystals not only have high transverse piezoelectric properties ($d_{31}$, $d_{32}$, $k_{31}$ and $k_{32}$) but also low transverse sound velocities ($v_{11}^E$ and $v_{22}^E$).

Table 1 compiles the relevant transverse and longitudinal piezoelectric properties and sound velocities of $[011]_3$-poled PZN-PT, PMN-PT and PIN-PMN-PT single crystals of $[0\text{-}11]_1x[100]_2x[011]_3$ cut, where PIN being abbreviation of $Pb[In_{1/2}Nb_{1/2}]O_3$.

| | Crystal composition | | |
|---|---|---|---|
| | $d_{31}/d_{32}/d_{33}$ (pC/N) | $k_{31}/k_{32}/k_{33}$ | $v_{11}^E/v_{22}^E/v_{33}^D$ (m/s)* |
| PZN-9% PT[a] ($\rho$ = 8316 kg/m$^3$) | 476/−1750/1237 | 0.33/0.90/0.89 | 1283/980/2980 |
| PZN-7% PT[b] ($\rho$ = 8038 kg/m$^3$) | 478/−1460/1150 | 0.35/0.86/0.87 | 1360/1100/2870 |
| PZN-(6-7)% PT[c, d] ($\rho$ = 8250 kg/m$^3$) | 1100/−3000/1900 | 0.75/0.91/0.90 | 1400/820/2900 |
| PZN-5.5% PT[e] ($\rho$ = 8250 kg/m$^3$) | 1000/−2600/1800 | 0.80/0.90/0.90 | 1460/880/3100 |

-continued

Table 1 compiles the relevant transverse and longitudinal piezoelectric properties and sound velocities of $[011]_3$-poled PZN-PT, PMN-PT and PIN-PMN-PT single crystals of $[0\text{-}11]_1x[100]_2x[011]_3$ cut, where PIN being abbreviation of $Pb[In_{1/2}Nb_{1/2}]O_3$.

| | Crystal composition | | |
|---|---|---|---|
| | $d_{31}/d_{32}/d_{33}$ (pC/N) | $k_{31}/k_{32}/k_{33}$ | $v_{11}^E/v_{22}^E/v_{33}^D$ (m/s)* |
| PMN-30% PT[f] ($\rho$ = 8150 kg/m$^3$) | 813/−2116/1916 | 0.71/0.94/0.92 | 2295/1120/3386 |
| PMN-29% PT[g] ($\rho$ = 8090 kg/m$^3$) | 610/−1883/1020 | 0.76/0.94/0.78 | 2620/1050/2460 |
| PMN-28% PT[f] ($\rho$ = 8090 kg/m$^3$) | 723/−1761/1776 | 0.65/0.89/0.91 | 2540/1230/3350 |
| PMN-28% PT[h] ($\rho$ = 8095 kg/m$^3$) | 447/−1150/860 | 0.66/0.85/0.90 | 3035/1510/4400 |
| xPIN-PMN-0.32PT[i] (x = 0.25-0.35; $\rho$ = 8102 kg/m$^3$) | 744/−1781/1363 | 0.75/0.90/0.92 | 2190/1100/3730 |
| xPIN-PMN-0.28PT[i] (x = 0.25-0.35; $\rho$ = 8185 kg/m$^3$) | 460/−1156/782 | 0.67/0.86/0.87 | 2600/1330/4030 |

*Deduced values using $v_{11}^E = \sqrt{1/(s_{11}^E\rho)}$, $v_{22}^E = \sqrt{1/(s_{22}^E\rho)}$ and $v_{33}^D = \sqrt{1/(s_{33}^D\rho)}$.

Table 2 provides transverse and longitudinal piezoelectric properties and sound velocities of $[001]_3$-poled PZN-PT and PMN-PT single crystals of $[110]_1x[1\text{-}10]_2x[001]_3$ cut.

| | Crystal composition | | |
|---|---|---|---|
| | $d_{31}/d_{33}$ (pC/N) | $k_{31}/k_{33}$ | $v_{11}^E/v_{33}^D$ (m/s)* |
| PZN-4.5% PT[j] ($\rho$ = 8250 kg/m$^3$) | −970/2000 | 0.82/0.90 | 1990/2425 |
| PZN-(6-7)% PT[c, d, e] ($\rho$ = 8250 kg/m$^3$) | −1200/2400 | 0.80/0.90 | 1740/2700 |
| PMN-28% PT[k] ($\rho$ = 8090 kg/m$^3$) | −1025/2000 | 0.88/0.93 | 2300/3264 |
| PMN-30% PT[k] ($\rho$ = 8090 kg/m$^3$) | −900/2200 | 0.80/0.92 | 2300/3264 |

*Deduced values using $v_{11}^E = \sqrt{1/(s_{11}^E\rho)}$ and $v_{33}^D = \sqrt{1/(s_{33}^D\rho)}$.

For instance, Table 1 shows that for $[011]_3$-poled PZN-(6-7) % PT single crystals, the piezoelectric strain coefficients and electromechanical coupling factors in both the $[0\text{-}11]_1$ and $[100]_2$ transverse crystal directions (being >1000 pC/N and >0.75, respectively) are several times those of PZT-based ceramics. In addition, this crystal cut exhibits comparatively low sound velocities in both transverse directions ($v_{11}^E \cong 1500$ m/s and $v_{22}^E < 1000$ m/s), being about or less than sound velocities in water and human tissues, of about 1500-1600 m/s collectively.

Similarly, excellent transverse properties are also noted for $[001]_3$-poled PZN-(4.5-7)% PT and PMN-28% PT single crystals of $[110]_1$ activated direction (Table 2). Typical values are $d_{31} \geq 1000$ pC/N, $k_{31} \approx 0.80$. Of the two compositions, PZN-PT crystals exhibit lower sound velocities in the transverse direction of $v_{11}^E \approx 1740\text{-}1990$ m/s, being closer to the sound velocities in water and human tissues.

The excellent piezoelectric properties and low sound velocities in the transverse directions of these single crystals make new sonic and ultrasonic transducers and arrays possible of which one of the operating modes is the transverse width mode of the present invention, as is illustrated below.

Figure 7:
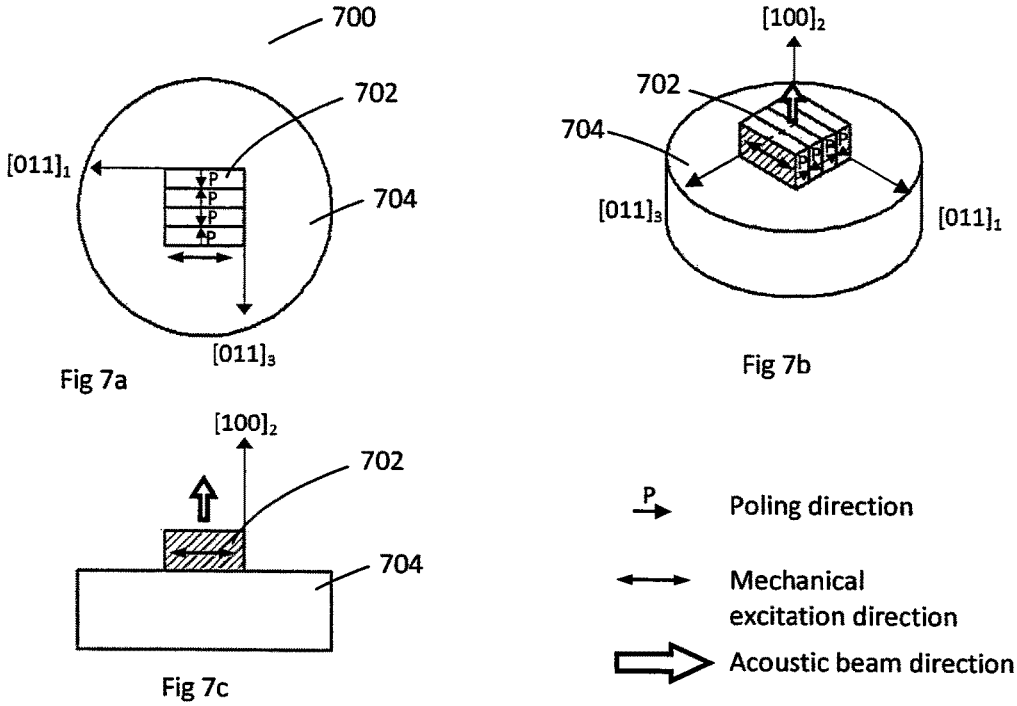
FIG. 7 illustrates an exemplary transducer of the present invention.
Figure 8A:
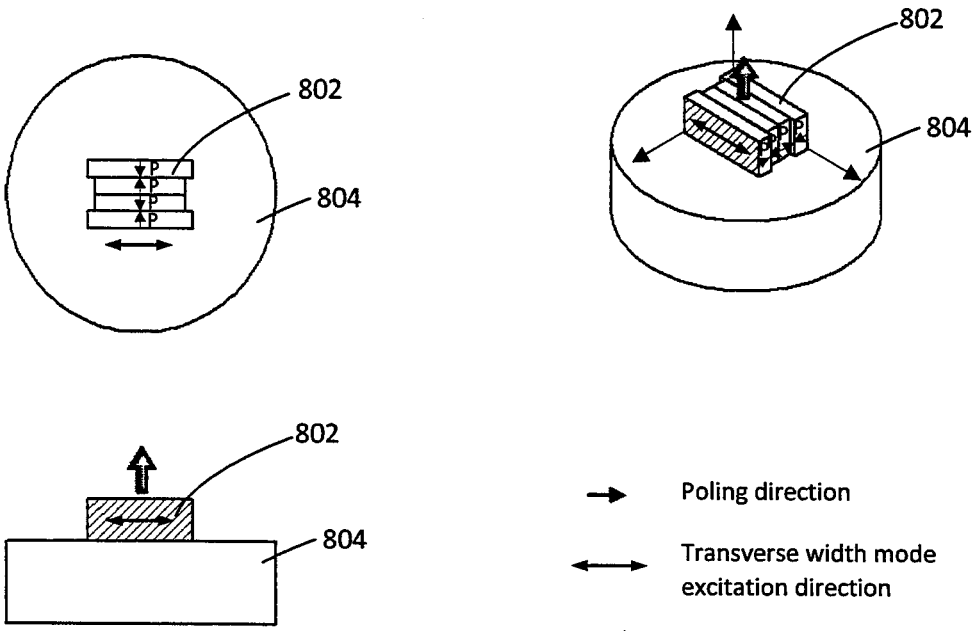
FIGS. 8(*a*)-(*d*) are exemplary illustrations of active elements of different transverse width dimensions and/or having a tapered profile for improving the bandwidth of the transducer in accordance with an embodiment of the present invention.
Figure 8B:
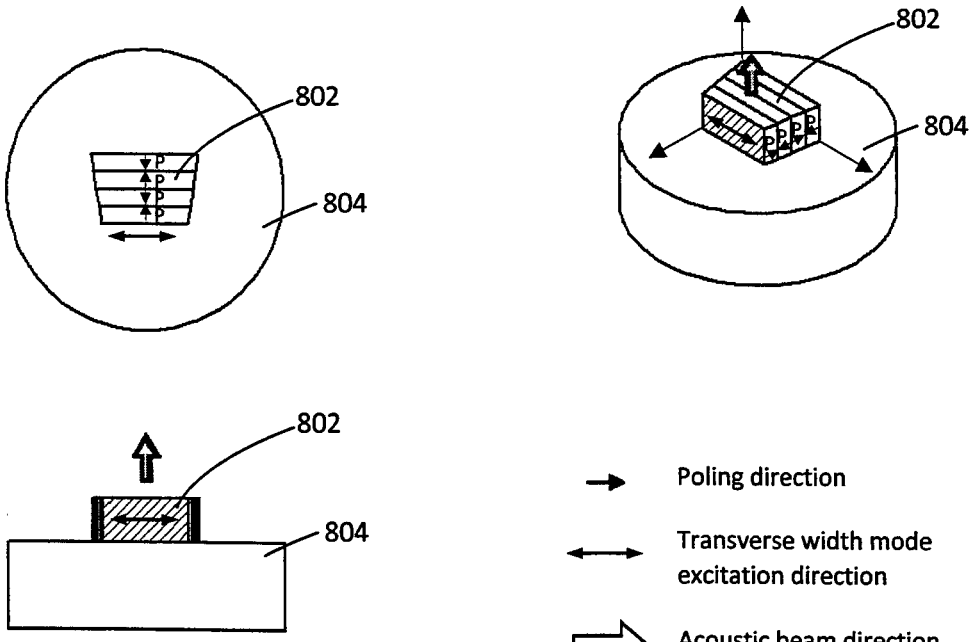
Figure 8C:
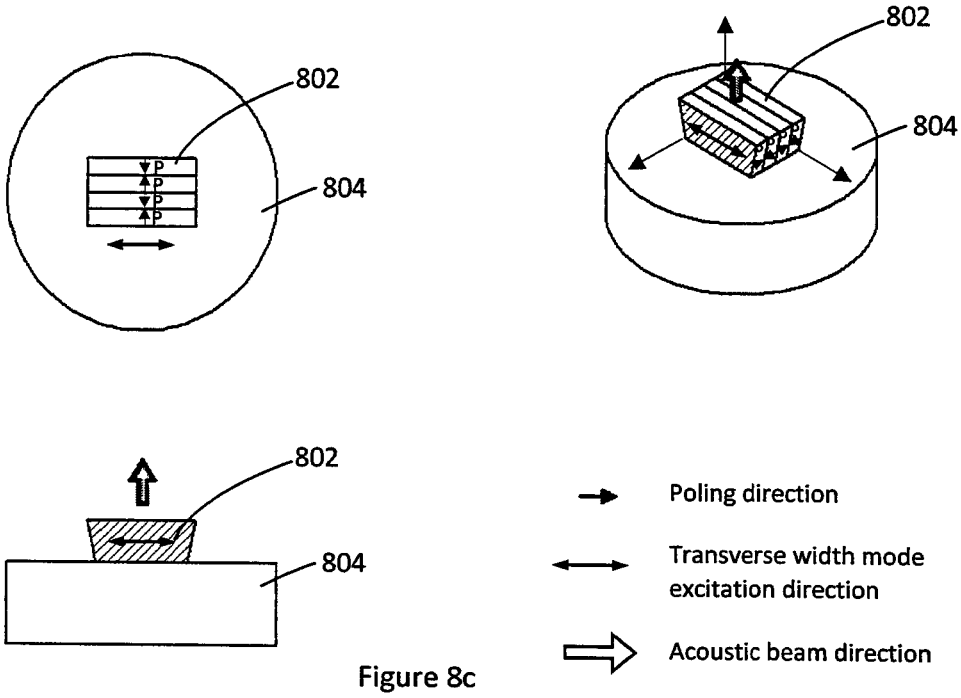
Figure 8D:
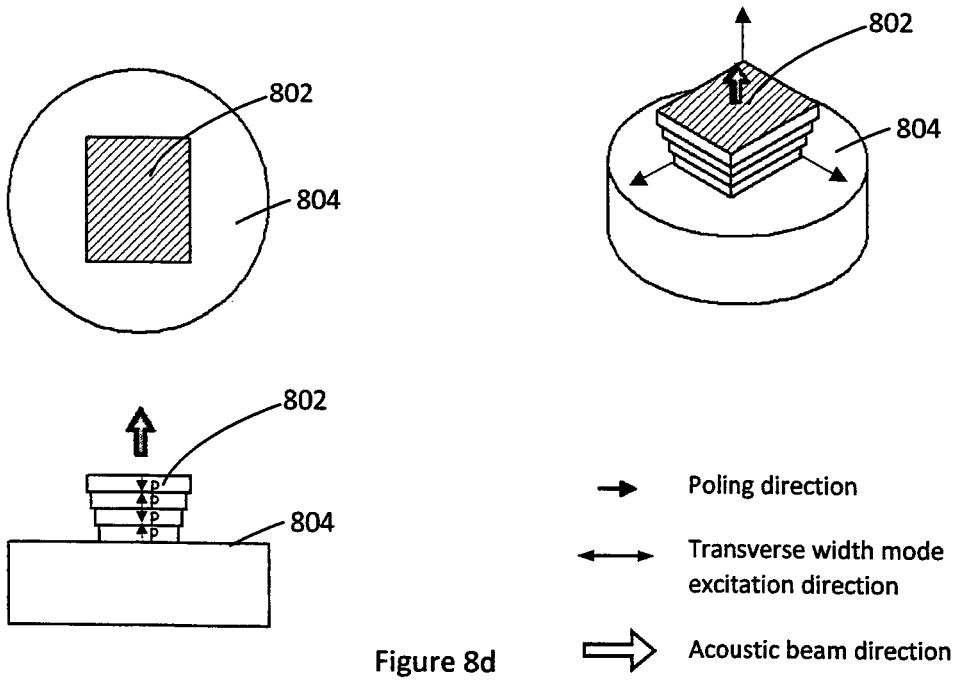

FIGS. 7*a-c* show an exemplary multi-crystal device, for example a multi-crystal transducer 700. FIG. 7*a* is the top view of the transducer 700 while FIG. 7*b* depicts a threedimensional view of the transducer 700. FIG. 7*c* depicts a perspective view of the transducer 700. The electroded faces are shaded as shown in the figures. As an example, the transducer 700 is designed to operate in the transverse width mode of the present invention for underwater application, namely, for transmitting sound at about 140 kHz in water.

The transducer 700 includes four $[011]_3$-poled PZN-5.5% PT single crystals 702 of the same cut and dimensions, each electroded on two opposite larger side faces and poled in the $[011]_3$ crystal direction (FIG. 7*a*). Though crystals of same cut and dimensions are used in this example, the dimensions and cut may be varied to suit the desired application as shown in FIGS. 8(*a-d*). The four $[011]_3$-poled PZN-5.5% PT single crystals 702 are coupled to an appropriate tail mass 704 at their bottom face. The four crystals 702 are connected in parallel electrically to reduce the driving voltage. Other wiring schemes such as series connection or part-parallel-and-part-series connection are also possible depending on actual application needs. For clarity, the surrounding stress/pressure release material, the lead wires connected to respective electroded faces and the housing are not shown in this figure.

The crystals may be designed to resonate in the transverse width mode along a number of directions. For example, as depicted in FIG. 7*b*, the crystals are designed to resonate in the transverse width mode along the $[0\text{-}11]_1$ lateral crystal direction at about 140 kHz. Taking sound velocity $v_{11}^E$=1460 m/s for said crystal cut (Table 1, Row 5), the dimension for $\lambda_c/2$ excitation in the $[0\text{-}11]_1$ lateral or width direction of the crystal is about 5.2 mm, which is less than the preferred elemental separation of $\lambda_m/2$=5.55 mm for the array taking sound velocity in water at 1500 m/s. The acoustic beam direction in this case is along the $[100]_2$ crystal direction, as indicated in FIG. 7*b*.

The crystal dimension in the $[0\text{-}11]_1$ lateral or width direction of transducer 700 may be altered to yield the desired sound frequency corresponding to $\lambda_c/2$ resonant excitation in said direction.

The transducer 700 includes four $[011]_3$-poled PZN-5.5% PT single crystals 702 of the same cut and dimensions, each electroded on two opposite larger side faces and poled in the $[011]_3$ crystal direction (FIG. 7*a*). Though crystals of same cut and dimensions are used in this example, the dimensions and cut may be varied to suit the desired application as shown in FIGS. 8(*a-d*). The four $[011]_3$-poled PZN-5.5% PT single crystals 702 are coupled to an appropriate tail mass (704, 804) at their bottom face. The four crystals 702 are connected in parallel electrically to reduce the driving voltage. Other wiring schemes such as series connection or part-parallel-and-part-series connection are also possible depending on actual application needs. For clarity, the surrounding stress/pressure release material, the lead wires connected to respective electroded faces and the housing are not shown in this figure.

Another example of a single crystal suitable for transverse width mode for sound projection is the $[001]_3$-poled crystal whose activated transverse direction is along the $[110]_1$ crystal direction. $[110]_1$ and $[1\text{-}10]_2$ are crystallographically equivalent directions for this crystal cut. For PZN-(6-7)% PT crystal of this crystal cut, the sound velocity along the $[110]_1$ transverse direction is close to that of water and human tissue. This crystal cut also has high transverse piezoelectric coefficients and electromechanical coupling factors, with $d_{31}$=1200 pC/N and $k_{31}$=0.80.

FIGS. 8(*a*)-(*d*) provide exemplary illustrations of active elements 802 of different transverse width dimensions and/or having a tapered profile for improving the bandwidth of the transducer resonating in transverse width mode in accordance with an embodiment of the present invention. The electroded faces are shaded for easy identification. Though the active element 802 is shown to be made of four crystals, the present invention extends to other embodiments of active element with one or more crystals.

This invention can therefore be applied to a range of active elements 502, 602, 702 or 802 made of piezoelectric single crystals of suitable compositions and cuts which possess reasonably high transverse piezoelectric properties of, say, $d_{31}$ (or $d_{32}$)≥400 pCN and $k_{31}$ (or $d_{32}$)≥0.60, including but not limited to ferroelectric/piezoelectric single crystals of binary, ternary, and higher-order solid solutions of the following components: $Pb(Zn_{1/3}Nb_{2/3})O_3$, $Pb(Mg_{1/3}Nb_{2/3})O_3$, $Pb(In_{1/2}Nb_{1/2})O_3$, $Pb(Sc_{1/2}Nb_{1/2})O_3$, $Pb(Fe_{1/2}Nb_{1/2})O_3$, $Pb(Yb_{1/2}Nb_{1/2})O_3$, $Pb(Lu_{1/2}Nb_{1/2})O_3$, $Pb(Mn_{1/2}Nb_{1/2})O_3$, $PbZrO_3$ and $PbTiO_3$, as well as their doped and modified derivatives.

The active elements 502, 602, 702 or 802 also include polycrystalline piezoelectric ceramics, either textured or non-textured, of suitable compositions and cuts which exhibit reasonably high transverse piezoelectric properties of, say, $d_{31}$ (or $d_{32}$)≥400 pCN and $k_{31}$ (or $d_{32}$)≥0.60. Alternatively, the active elements 502, 602, 702 or 802 may be modified and new compositions and cuts of piezoelectric materials including single crystals, textured and non-textured polycrystalline ceramics which exhibit reasonably high transverse piezoelectric properties of, say, $d_{31}$ (or $d_{32}$)≥400 pCN and $k_{31}$ (or $d_{32}$)≥0.60. Preferably, said single crystals, textured and non-textured ceramics have sound velocities that are approximate to or less than the sound velocity in the intended acoustic medium in at least one transverse direction.

Figure 9:
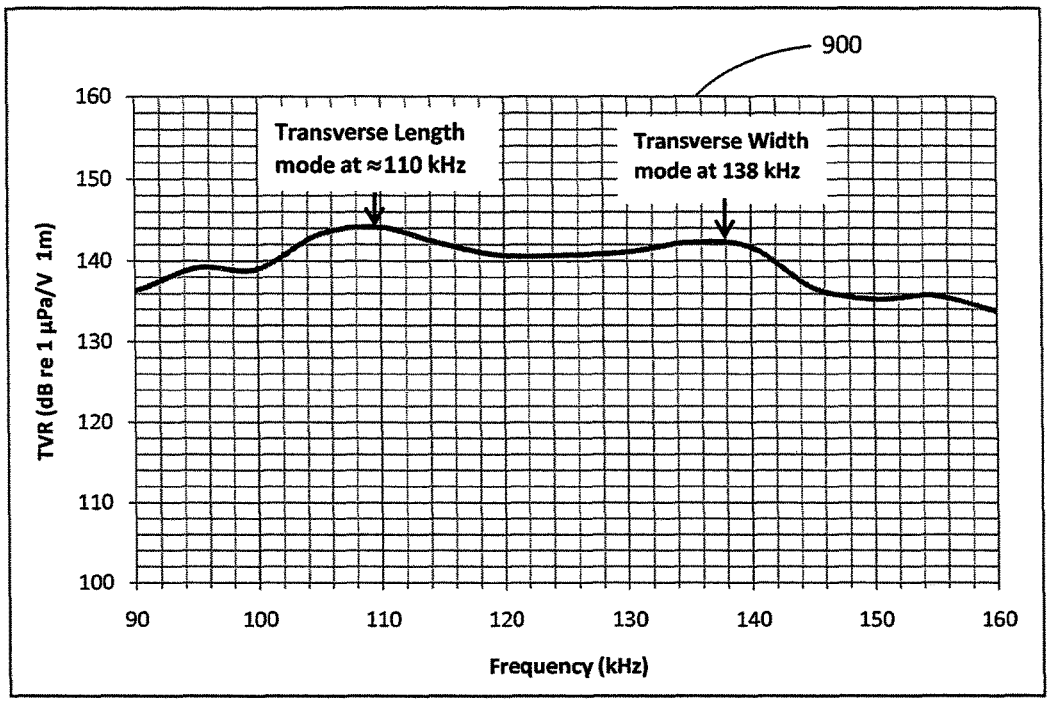
FIG. 9 shows the transmit voltage response (TVR) of the transverse width mode over 125 kHz to 150 kHz for the exemplary transducer described in FIG. 7.

FIG. 9 shows the transmit voltage response (TVR) graph 900 of the exemplary transducer 700 in which the resonant mode at 138 kHz is the transverse width mode of the present invention.

In the transverse width mode, due to high transverse piezoelectric coefficients and electromechanical coupling factors of the single crystal cut used ($d_{31}$≈1000 pC/N and $k_{31}$≈0.80, see Row 5 of Table 1), said transducer element exhibits respectable TVR peak of 142 dB re 1 μPa/V at 1 meter for the transverse width mode at about 138 kHz and a reasonably high sound pressure level of >180 dB re 1 μPa at 1 meter per element at a maximum a.c. input voltage of about 100 $V_{rms}$ without any d.c. bias. Higher sound pressure levels are possible when said element is driven at higher a.c. voltages under appropriate d.c. bias.

In addition to the TVR peak corresponding to the transverse width mode, FIG. 9 also depicts a TVR peak in the transverse length mode exhibited by the same crystal when resonated at 110 kHz via the $\lambda_c/4$ mode along its other transverse $[100]_2$ crystal direction. Thus, the graph 900 shows that the TVRs (and hence source levels) of both the transverse width mode of the present invention and the transverse length mode are comparable, confirming the former as a viable operating mode for sound and ultrasound generation.

Graph 900 further indicates that when the resonant frequencies of the transverse width and length modes can be designed to be sufficiently apart, the resultant transducer, being an example of the present invention, can be used as a dual-frequency transmitter operating at 110 kHz and 140 kHz respectively as shown.

Figure 10:
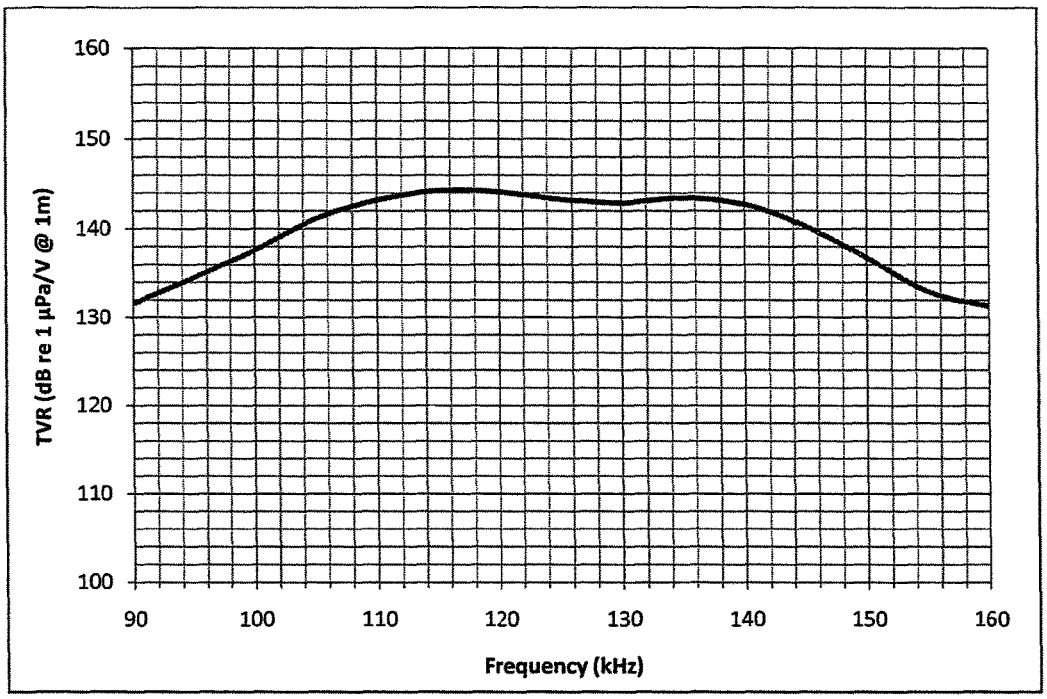
FIG. 10 shows the transmit voltage response (TVR) of yet another exemplary transducer of the present invention.

Alternatively, the transducer element of the present invention may be designed to have sufficiently close resonant frequencies for the transverse width mode and the transverse length mode such that the resulting acoustic beam would couple to form broadband resonance instead. An example of the TVR produced by such a design is shown in FIG. 10. The crystals used in this exemplary transducer are of the same cut as in FIG. 7 but of a shorter dimension in the $[100]_2$ direction to yield a slightly higher resonant frequency for the transverse length mode.

Yet another exemplary broadband transducer in accordance with the teachings of the present invention may operate in a broadband coupled mode between a suitable transverse width mode and the longitudinal mode by designing them to have sufficiently close resonant frequencies.

Yet another exemplary broadband transducer in accordance with the teachings of the present invention may be activated in transverse width mode in both lateral or width directions of the crystals and the longitudinal mode. In this case, the dimensions of the crystals may be selected such that the resonant frequencies of the two transverse width modes and the longitudinal mode are sufficiently close to form a coupled resonance of ultra-broad bandwidth.

An exemplary design for the activation of both the transverse width modes and the longitudinal mode in ultra broadband underwater application is illustrated below. In this example, $[011]_3$-poled PZN-5.5% PT single crystal is used as the active element, with $[0\text{-}11]_1$ and $[100]_2$ being the two orthogonal transverse crystal directions. The sound velocities of this crystal cut in the three respective crystal directions are: $v_{33}^{D}\approx 3100$ m/s for the $[011]_3$ longitudinal direction, $v_{11}^{E}\approx 1460$ m/s for the $[0\text{-}11]_1$ transverse direction and $v_{22}^{E}\approx 880$ m/s for the $[100]_2$ transverse direction (Table 1, Row 5). In this example, the $[011]_3$ crystal direction is used as the acoustic beam direction, the $[0\text{-}11]_1$ and $[100]_2$ crystal directions as the two transverse width directions. The crystal is cut to have the following approximate dimensions: 5.2 mm in the $[011]_3$ crystal direction for $\lambda_c/4$ activation via the longitudinal mode with a heavy tail mass, 6.1 mm in the $[0\text{-}11]_1$ crystal direction for $\lambda_c/2$ activation via the first transverse width mode in said direction, and 4.9 mm in the $[100]_2$ crystal direction for $\lambda_c/2$ activation via the second transverse width mode. The corresponding resonant frequencies are estimated at 90 kHz for the first transverse width mode, 120 kHz for the second transverse width mode and 150 kHz for the longitudinal mode, which are sufficiently close for ultra broadband ultrasound transmission and reception purposes. Further, the crystal dimensions may be adjusted to yield either separate resonances or a coupled resonance depending on actual application requirements.

In the broadband transducer as referred above, the acoustic waves generated by the transverse width mode, the transverse length mode and the longitudinal mode are all in phase. Therefore, the formation of a coupled mode may not be necessary when designing a broadband or ultra broadband transducer. In other words, a reasonably flat TVR response, say, within 10 dB variations, can be realized via combined activation of (a) the transverse width mode and the transverse length mode, (b) a suitable transverse width mode and the longitudinal mode, or (c) both transverse width modes and the longitudinal mode while keeping the resonant frequencies of respective modes sufficiently close to one another.

It should be noted that due to mechanical constraint imposed by the tail mass, the boundary condition for transverse width mode resonances of the active material in the vicinity of the tail mass is altered locally. In other words, the transverse width mode of the present invention would exhibit a distributed or broader resonance compared with when the constraint is absent. The distributed resonant behavior is expected to be enhanced when additional constraints are present which would further affect the vibration behavior of the intended transverse width mode of the active material, such as, addition of a head mass (or piston) of either rigid or flexural type, suitable matching layer or layers, and/or a lens layer. The imposed boundary conditions at the top face of the crystal would further enhance the distributed resonance nature of the transverse width mode of the present invention, giving rise to improved bandwidth.

Further, other methods which may be employed to promote the distributed resonance behavior of the transverse width mode and hence increase the bandwidth of the transducer include the use of active materials of slightly different transverse width dimensions as well as those with appropriately tapered profile in at least one dimension, as shown exemplarily in FIGS. 8(*a*)-(*d*).

Figure 11:
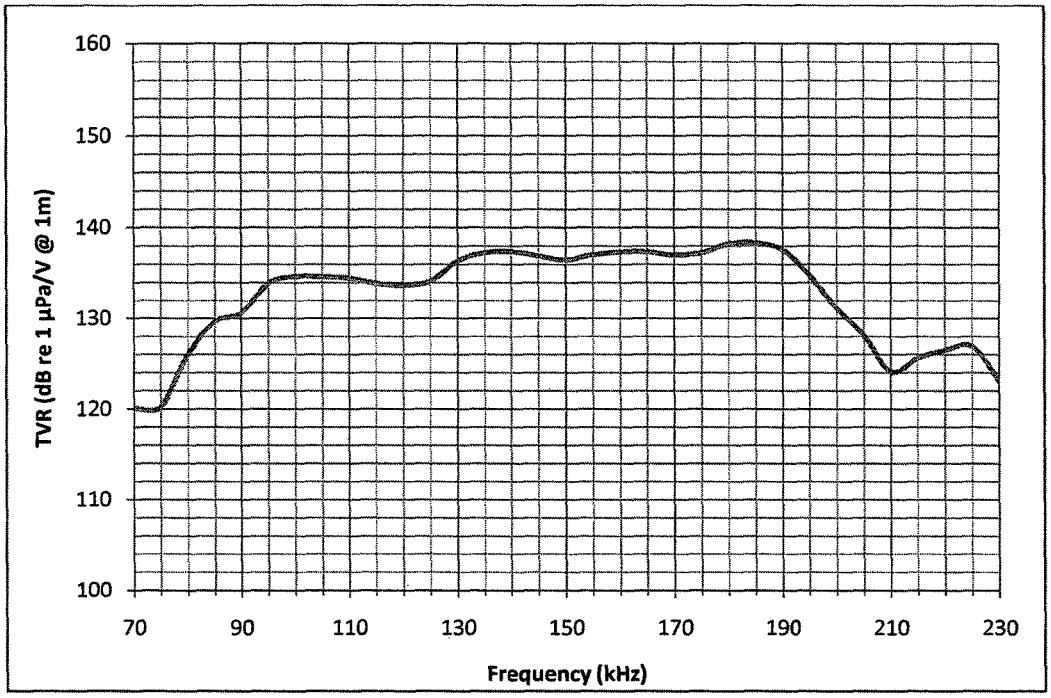
FIG. 11 shows the transmit voltage response (TVR) of extended bandwidth of yet another exemplary transducer of the present invention.

FIG. 11 shows the TVR of expanded bandwidth of yet another exemplary transducer of the present invention. The exemplary transducer is of comparable design to FIG. 7 but with a suitable quarter-wavelength matching layer added onto its top projecting face. The much increased bandwidth of this design for the transverse width mode over 130-190 kHz as opposed to the piston-less design shown in FIG. 9 is evident. Similar results are expected when a suitable head mass or compound matching layers are used instead.

It is evident from the above examples that the transverse width mode of the present invention can be utilized in various suitable forms in transducer design to suit various application needs. These include the dual or triple frequency mode, broadband coupled mode, ultra broadband mode with either suitable head mass and/or matching layer, with single or a plurality of active elements of identical or slightly different transverse width dimensions, etc. Despite these very attractive design features, each active element is approximately or less than $\lambda_m/2$ in dimension in the activated transverse direction allowing arrays of different configurations of about or less than $\lambda_m/2$ elemental separation to be realized. The acoustic performance of the fabricated arrays can be predicted readily via conventional beamforming technique. Electronic beam shading and steering are applicable in this case.

The transverse width mode of the present invention also applies to transducer designs with a suitable soft backing layer, as illustrated exemplarily in FIG. 6. All the above described effects remain applicable except that the resultant acoustic power is reduced with expanded bandwidth in this case.

In an embodiment, the transverse width mode also applies to cases when the velocities of the active material in both transverse width directions are larger than the velocities of sounds in the intended acoustic medium. In such a case, the lateral dimension(s) of the active material in the resonating width direction(s) will be larger than half the wavelength ($\lambda_m/2$) of sound of intended central frequencies in the medium. It also applies to transducer arrays made from such elements.

The present invention also applies to sound and ultrasound reception using transducer elements and arrays for sounds of frequencies comparable to the transverse width resonances of the constituting elements in receiving mode. A much enhanced receiving sensitivity is achieved in this case compared with when the transducer is working in the off-resonance mode.

The present invention further applies to transducers and their arrays for combined sound and ultrasound transmission and reception. Either resonant or off-resonant mode may be used for sound reception in this case.

The transducers and their arrays of the present invention find application in a number of fields—underwater applications (for example, underwater imaging, ranging and communications with typical operating frequency range from low tens of kHz to low tens of MHz), medical applications (for example, in medical imaging for which typical operating frequencies range from mid hundreds of kHz to high tens of MHz), and industrial applications (for example, in structural and flaw imaging for which the operating frequencies may vary widely from high tens of kHz to high tens of MHz depending on the material being examined).

It would be obvious to a skilled person that the configurations, dimensions, materials of choice of the present embodiment may be adapted, modified, refined or replaced with a slightly different but equivalent method without departing from the principal features of the working principle of the invention, and additional features may be added to enhance the performance and/or reliability of the transducer and array. These substitutes, alternatives, modifications, or refinements are to be considered as falling within the scope and letter of the following claims.

Further, the variations of the above disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A transducer used for sound and ultrasound generation and reception, comprising:

an active element electroded on two opposite faces and poled across the electroded faces, wherein when the active element is set in resonance in a transverse width direction, an acoustic beam is generated in either the poling direction or the other transverse direction, both being orthogonal to the resonating transverse width direction.

2. The transducer of claim 1, wherein the active element comprises a single piece of active material or a plurality of active materials of identical or comparable dimensions and cut, wherein said cut is either rectangular shape or tapered profile in at least one dimension, and wherein said plurality of active materials are electrically coupled in one of a parallel, series, part-parallel, or part-series configuration.

3. The transducer of claim 2, wherein the active material is excited in half-wavelength resonant mode in the activated transverse direction.

4. The transducer of claim 2, further comprising a backing element bonded onto the face opposite to the acoustic wave emitting face of the active element, wherein the backing element comprises one of a heavy tail mass or a soft and high-damping backing material to suit a desired application.

5. The transducer of claim 2, wherein the transducer comprises a direct-drive, piston-less design.

6. The transducer of claim 2, further comprising one or more of a head mass, a matching layer and/or a lens layer to suit a desired application.

7. The transducer of claim 2, wherein the active element comprises one of suitably cut and poled piezoelectric single crystal or textured piezoelectric ceramics, of which the single crystals comprising one of binary, ternary, and higher-order solid solutions of one or more of $Pb(Zn_{1/3}Nb_{2/3})O_3$, $Pb(Mg_{1/3}Nb_{2/3})O_3$, $Pb(In_{1/2}Nb_{1/2})O_3$, $Pb(Sc_{1/2}Nb_{1/2})O_3$, $Pb(Fe_{1/2}Nb_{1/2})O_3$, $Pb(Yb_{1/2}Nb_{1/2})O_3$, $Pb(Lu_{1/2}Nb_{1/2})O_3$, $Pb(Mn_{1/2}Nb_{1/2})O_3$, $PbZrO_3$ and $PbTiO_3$, including their modified and/or doped derivatives.

8. A device for sound and ultrasound generation and/or reception, the device comprising:

an array of transducers, wherein each transducer comprises an active element electroded on two opposite faces and poled across the electroded faces, wherein when the active element is set in resonance in a transverse width direction, an acoustic beam is generated in either the poling direction or the other transverse direction, both being orthogonal to the resonating transverse width direction.

9. The device of claim 8, wherein the active element comprises a single piece of active material or a plurality of active materials of identical or comparable dimensions and cut, wherein said cut is either rectangular shape or tapered profile in at least one dimension, and wherein said plurality of active materials are electrically coupled in one of a parallel, series, part-parallel or part-series configuration.

10. The device of claim 9, wherein each transducer further comprises a backing element bonded onto the face opposite to the acoustic wave emitting face, the said backing element comprises one of a heavy tail mass or a soft and high-damping backing material to suit a desired application.

11. The device of claim 9, wherein each transducer further comprises a direct-drive piston-less design or one or more of a head mass, a matching layer and a lens layer to suit a desired application.

12. The device of claim 9, wherein the array of transducers operate in dual or multi-frequency mode, wherein at least one of the operating modes is the transverse width mode.

13. The device of claim 9, wherein the array of transducers operate in a broadband multi-frequency mode comprising coupled mode or a mixture of uncoupled and coupled modes, wherein at least one of the uncoupled modes or one of the constituting fundamental modes of the coupled mode is the transverse width mode.

14. The device of claim 9, wherein at least one transducer of the array operates in the transverse width mode.

* * * * *